US007267230B1

(12) United States Patent
Smith

(10) Patent No.: US 7,267,230 B1
(45) Date of Patent: Sep. 11, 2007

(54) MOBILE AIR POWERED MATERIAL SEPARATOR

(75) Inventor: Mark C. Smith, Rockville, MD (US)

(73) Assignee: Marcor Management, Inc., Hunt Valley, MD (US)

( * ) Notice: Subject to any disclaimer, the term of this patent is extended or adjusted under 35 U.S.C. 154(b) by 168 days.

(21) Appl. No.: 10/631,957

(22) Filed: Aug. 1, 2003

Related U.S. Application Data

(60) Provisional application No. 60/400,043, filed on Aug. 2, 2002.

(51) Int. Cl.
*B07B 7/00* (2006.01)

(52) U.S. Cl. ..... 209/139.1; 209/147

(58) Field of Classification Search ..... 209/20, 209/138, 139.1, 147, 477, 488, 490, 492, 209/906, 925, 136, 137, 502
See application file for complete search history.

(56) References Cited

U.S. PATENT DOCUMENTS

| | | | | |
|---|---|---|---|---|
| 775,965 | A | 11/1904 | Edison | |
| 977,956 | A | 12/1910 | Langerfield | |
| 1,042,836 | A | 10/1912 | Stromborg | |
| 1,356,384 | A | 10/1920 | Marshall | |
| 1,912,910 | A * | 6/1933 | Neuman et al. | 209/2 |
| 2,222,861 | A | 11/1940 | Stoner | |
| 2,328,569 | A * | 9/1943 | McGaw | 604/506 |
| 2,828,011 | A | 3/1958 | Whitby | |
| 2,968,069 | A | 1/1961 | Powell | |
| 2,978,103 | A | 4/1961 | Cowher | |
| 3,269,532 | A | 8/1966 | Moore | |
| 3,522,012 | A | 7/1970 | Blann | |
| 3,643,797 | A | 2/1972 | Berkowitz | |
| 3,757,946 | A | 9/1973 | Berkowitz | |

(Continued)

FOREIGN PATENT DOCUMENTS

| | | |
|---|---|---|
| CA | 2048182 | 2/1992 |

(Continued)

OTHER PUBLICATIONS

Marcor drawing entitled "Marcor's Pneumatic Separation Unit", Admitted Prior Art (2002), exact date unknown.

(Continued)

*Primary Examiner*—Joseph C. Rodriguez
(74) *Attorney, Agent, or Firm*—Roylance, Abrams, Berdo & Goodman, L.L.P.

(57) ABSTRACT

An apparatus for separating a mixed particulate material into particles of at least two different specific gravities or ranges of specific gravity, wherein the apparatus comprises an air compressor for providing compressed air into the discharge tube, which, through the venturi effect, creates a vacuum in a connecting hose. The connecting hose is connected to the top of a separation chamber wherein the mixed particulate material, which is vacuumed in by a vacuum hose, is separated and the particles fall into a hopper, while the lighter material is discharged from the discharge tube by virtue of the vacuum created by the flow of compressed air. A conveyor can be used to collect either or both of the lower and higher specific gravity materials, and bring them to other locations. A number of different sensors can be added to the automatic unloader valve to determine when a pre-determined amount of material has been collected. The entire operation of the apparatus can be controlled by a computer, which can also be connected through a network to other computers whereby the apparatus for separating materials can be operated remotely.

23 Claims, 10 Drawing Sheets

U.S. PATENT DOCUMENTS

| | | | | | |
|---|---|---|---|---|---|
| 3,843,060 | A | * | 10/1974 | Colburn | 241/19 |
| 3,933,626 | A | | 1/1976 | Stukel | |
| 4,519,896 | A | | 5/1985 | Vickery | |
| 4,840,727 | A | | 6/1989 | Humphrey | |
| 5,032,256 | A | | 7/1991 | Vickery | |
| 5,195,640 | A | | 3/1993 | Seaverns | |
| 5,409,118 | A | | 4/1995 | Bielagus | |
| 5,411,142 | A | * | 5/1995 | Abbott et al. | 209/29 |
| 5,518,188 | A | * | 5/1996 | Sharer | 241/14 |
| 5,579,920 | A | | 12/1996 | Garabedian | |
| 5,732,829 | A | | 3/1998 | Smith | |
| 5,934,477 | A | | 8/1999 | Smith | |
| 5,934,482 | A | | 8/1999 | Smith | |
| 5,967,333 | A | | 10/1999 | Smith | |
| 6,726,021 | B2 | * | 4/2004 | Kennedy et al. | 209/139.1 |
| 6,883,668 | B1 | * | 4/2005 | Lindsey et al. | 209/132 |

FOREIGN PATENT DOCUMENTS

| | | |
|---|---|---|
| DE | 2535881 | 2/1977 |

OTHER PUBLICATIONS

Marcor drawing entitled "Pneumatic Separation Unit"., Admitted Prior Art (2002), exact date unknown.
Marcor drawing entitled "Deflector Shield for Pneumatic Separation Unit", Admitted Prior Art (2002), exact date unknown.

* cited by examiner

600

600

MOBILE AIR POWERED MATERIAL SEPARATOR

PRIORITY

The present application claims priority under 35 U.S.C. § 119(e) to U.S. Provisional Patent Application Ser. No. 60/400,043, filed Aug. 2, 2002, the entire content of which is expressly incorporated herein by reference.

FIELD OF THE INVENTION

The present invention is directed generally to separation apparatus, and is particularly concerned with a mobile apparatus for separating mixed particulate material into particles of different sizes and/or different specific gravities. The invention also relates to method for separating mixed particulate materials into particles of different sizes and/or specific gravities and to methods for operating a mobile mixed particulate material separation apparatus in accordance with the characteristics of the material being separated.

BACKGROUND OF THE INVENTION

There are many situations in which it is necessary to separate a mixed granular or particulate material into granules or particles of different sizes, specific gravities or both. One example, in connection with which the present invention finds particular utility, is the remediation of indoor or outdoor firearm training facilities which have become saturated with lead from used bullets. In this saturated state, it can be unsafe to continue use of the firearm training facilities. In order to restore these sites to an unsaturated, usable condition, the lead bullets must be removed from the backstop material with which they are mixed, and then the backstop material may then be re-used, recycled or discarded. Different types of backstop material (e.g., sand, or granulated rubber), make it difficult to use any one type of remediation system at different facilities. Mechanical screening can, at least to some degree, be used to separate the mixture of backstop material and bullets into its component parts; however, since mechanical screening relies on size differences between the granules or particles to be separated, it is not capable of separating bullets and backstop material which are of the same or similar size.

Separation of used bullets from backdrop material allows for recycling of the lead, which requires a certain level of purity in the product to be recycled. By separating the lead bullets from similarly sized backstop material, the backstop material can be returned to the site for repeated usage. The lead bullets can then be removed from the site in a relatively pure form for recycling and reuse.

Air separation (also known as dry separation) provides a method for separating mixed granular or particulate materials into their component parts by relying on differences in the specific gravity (rather than size) of the granules or particles to be separated. The theory of air separation is well understood by those skilled in art. Briefly, air separation is carried out by allowing the mixed granular or particulate material to fall vertically by gravity across a horizontal stream or flow of air. Assuming that all of the granules or particles are of approximately the same size (and hence experience approximately the same drag force from the moving air), granules or particles of greater mass will be accelerated more slowly by the moving air than those of lesser mass. As a result, the heavier granules or particles will fall closer to the initial drop point than the lighter granules or particles. By positioning hoppers or receptacles at these locations, the heavier and lighter granules or particles can be collected and processed separately. Examples of air separators can be found in U.S. Pat. Nos. 775,965 and 2,978,103.

In theory, air separation provides a useful way to separate lead bullets from backstop material of similar size in an environmental remediation operation of the type described above. In reality, however, there are a number of problems with the prior art approaches. For example, prior art air separators are generally designed to operate with small size granular or particulate materials, but the backstop material at an indoor remediation site is generally much larger in granule size than typically encountered with outdoor granular materials. This can result in poor separation between the backstop material and lead bullets. Still another problem with existing types of air separators is the fact that the prior art separators are bulky, are by design more complicated, require large amounts of space, and are not mobile.

Yet another difficulty with the prior art separators is that use of them with firearm training facilities sometimes requires shutting down the facility to move all the saturated backstop material to the prior art separator where separation of the bullets from the backstop material occurs. The cleaned backstop material can then be reused in the same facility, or sold as scrap or for some other purpose.

SUMMARY OF THE INVENTION

It is therefore a general object of the invention to provide a mobile material separator that will obviate or minimize problems of the type previously described.

A primary object of the present invention is provide an apparatus which is capable of separating a mixed backstop material into particles of at least two different specific gravities or ranges of specific gravity, and which can be adjusted to accommodate the specific characteristics of the mixed particulate material which is to be separated. As used herein, the term "particles" shall refer to any particulate or granular material containing granules, particles or other discrete components of at least two different specific gravities or ranges of specific gravity.

Another object of the invention is to provide a separation apparatus which is useful for separating lead bullets from backstop material as part of a remediation effort, and which is also useful for separating other types of mixed granular materials into their component parts.

A further object of the invention is to provide a separation apparatus which is useful for separating lead bullets from backstop material as part of a saturation remediation effort.

The present invention is also directed to methods for separating mixed particle material into particles of different sizes and/or specific gravities, and to methods for operating a mixed particle material separation apparatus to accommodate different types of and characteristics of mixed particle materials. These methods can be carried out using the exemplary apparatus disclosed and claimed herein.

A further object of the invention is to provide an apparatus for separating mixed particle material into particles of at least two different specific gravities or ranges of specific gravity, and which can operate in a continuous closed loop mode.

It is a further object of the invention to provide an apparatus for separating a mixed particulate material into particles of at least two different specific gravities or ranges of specific gravity.

A further object of the invention is to provide an apparatus for separating a mixed particulate material into particles of at least two different specific gravities or ranges of specific gravity, and which will place lighter material back in its original location.

A further object of the invention is to provide an apparatus for separating a mixed particulate material into particles of at least two different specific gravities or ranges of specific gravity, which will place the lighter material back to a more desirable location.

It is a further object of the invention to provide an apparatus for separating mixed particulate material into particles of at least two different specific gravities or ranges of specific gravity, wherein an air flow mechanism, tube, chamber size, and chamber length can be modified to accommodate materials of varied specific gravities.

It is a specific object of the invention to provide an apparatus for separating a mixed particulate material into particles of at least two different specific gravities or ranges of specific gravity, that can separate used bullets or other firearm projectiles from backstop material.

The above-described objects are realized by the present invention which relates to an apparatus for separating mixed particulate material into particles of at least two different specific gravities or ranges of specific gravity. In a preferred embodiment, the apparatus comprises an air compressor for providing compressed air into the discharge tube, which, through the venturi effect, creates a vacuum in a connecting hose. The connecting hose is connected to the top of a separation chamber wherein the mixed particulate material, which is vacuumed in by a vacuum hose, is separated and the heavier materials (higher specific gravity) fall into a hopper, while the light backstop material (lower specific gravity) is discharged from the discharge tube by virtue of the vacuum. In addition, the apparatus also comprises an air adjustment valve, automatic unloader valve, stand and discharge tube adjuster. In other embodiments of the invention, conveyor systems can be used to collect either or both the lower and higher specific gravity materials, and bring them to other more convenient locations. A number of different sensors can be added to the automatic unloader valve to determine when a pre-determined amount of higher specific gravity material has been collected. The entire operation of the apparatus can be controlled by a computer, which can also be connected through a network to other computers whereby the apparatus for separating materials can be operated remotely.

BRIEF DESCRIPTION OF THE DRAWINGS

The novel features and advantages of the present invention will best be understood by reference to the detailed description of the preferred embodiments which follows, when read in conjunction with the accompanying drawings, in which.

DETAILED DESCRIPTION OF THE PREFERRED EMBODIMENTS

Figure 1:
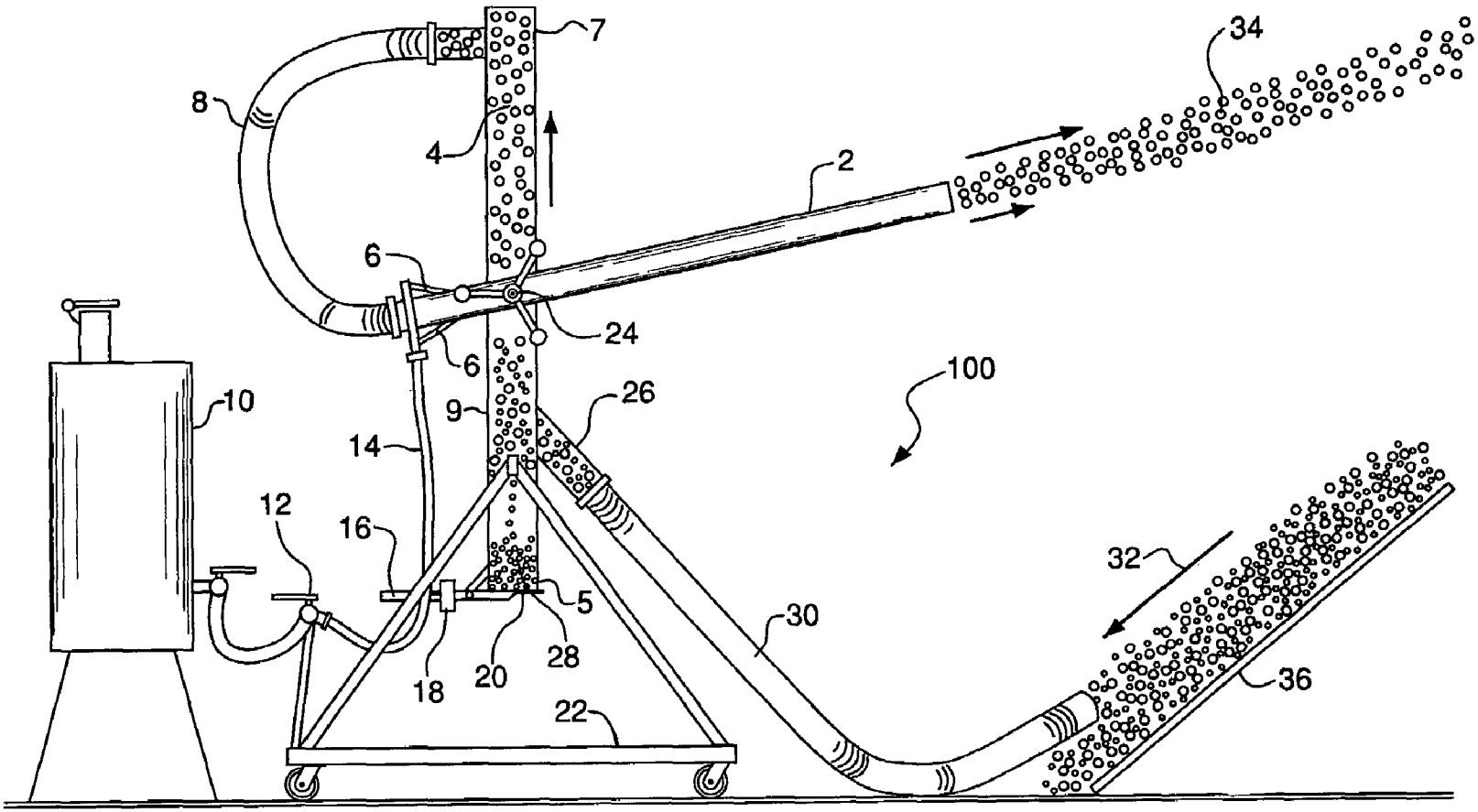
FIG. 1 is a block diagram of a mobile air powered material separator in accordance with a first embodiment of the present invention.

The various features of the preferred embodiments will now be described with reference to the drawing figures, in which like parts are identified with the same reference characters. The following description of the presently contemplated best mode of practicing the invention is not to be taken in a limiting sense, but is provided merely for the purpose of describing the general principles of the invention.

FIG. 1 is a block diagram of a mobile air powered material separator 100 in accordance with a first embodiment of the invention. The mobile air powered material separator (material separator) 100 is constructed to perform the following operations in one continuous closed loop: transport a mixed material comprising particles of different specific gravities; separate the transported material by specific gravity; and replace the lighter material back to its original location, or to a more desirable one. Airflow, tube and chamber size, and chamber length can be changed to accommodate materials of varied specific gravities.

Air compressor 10 is a commercially available air compressor, of which many different manufacturers are known in the industry. Preferably, though not necessarily, air compressor 10 will discharge air at a volume of 1200 CFM and 100 to 125 PSI. Compressed air from air compressor 10 is fed into four injector tubes 6, which direct air into a discharge tube 2. Using air adjustment valve 12, the amount of compressed air feeding the injector tubes 6 can be varied to achieve desirable separation levels on materials with different specific gravities. Other CFM values can be used (for example 850 CFM can be used in other applications) than that mentioned above. These CFM values can be higher, as air adjustment valve 12 can regulate the flow of air from air compressor 10 into discharge tube 2. The injector tubes 6 are placed in a manner so as not to restrict flow in the discharge tube 2. As the air exits the discharge tube 2, a resulting vacuum is created behind the injector tubes 6. A higher CFM value yields a higher vacuum in the separation chamber 4, angle of entry connection 26, connecting hose 8 and discharge tube 2. This vacuum is transferred to the separation chamber 4 by a connecting hose 8. The separation chamber 4, being larger in area, slows the air flow down. The air moves through material separator 100 from the bottom 5 to the top 7 of the separation chamber 4. As a result of the design of the separation chamber 4, angle of entry connection 26 and the venturi effect upon both of those items, there is little or no air flow velocity in the separation chamber 4 at any point just below the location where the angel of entry connection 26 intersects with the separation chamber 4.

Material 32 will enter the separation chamber 4 through the angle of entry connection 26 via vacuum hose 30. Angle of entry connection 26 is located at the lower portion 9 of the separation chamber 4. The vacuum created by air moving through injector tubes 6, into discharge tube 2, draws material 32 through the vacuum hose 30 into the separation chamber 4. Material 32 is generally composed of a mixture of lower specific gravity material 34 and higher specific gravity material 28. In an exemplary embodiment of the present invention, the material separator 100 is used to clean backstop material of bullets in firearms training or practice facilities. In this case, therefore, the lower specific gravity material 34 are the particles of rubber (or granulated rubber backstop material 55) and the higher specific gravity material 28 are bullets 57. The combination of bullets 57 and granulated rubber backstop material 55 is the material 32.

The angle at which angle of entry connection 26 makes with respect to separation chamber 4 is important for proper functioning of material separator 100. If, for example, the angle between angle of entry connection 26 and separation chamber 4 is 90°, then little or no material would travel up separation chamber 4. This results because the vacuumed material 32 travels straight into separation chamber 4 and strikes the opposite wall; the vacuumed material 32 has no upward velocity vector. While it can be possible to attach a sufficiently large air compressor 10 to the material separator 100 to draw vacuumed material 32 up the separation chamber 4 even in that extreme circumstance, such an embodiment would not be preferred. On the other extreme, if the angle between angle of entry connection 26 and separation chamber is 0° (i.e., pointing straight up), then it is possible that no separation of material will occur, as the material with higher specific gravity (i.e., the bullets) do not strike the inner wall of separation chamber 4 which causes them to slow down, and thus do not fall onto automatic unloader valve 20. Thus, there are a range of angles that the angle of entry connection 26 can make with separation chamber 4. Preferably, the angle between the angle of entry connection 26 and the separation chamber 4 should be between 40° and 50°. More preferably, the angle between the angle of entry connection 26 and the separation chamber 4 should be at or about 45°. Though the angle between the angle of entry connection 26 and the separation chamber 4 can be made variable, in the preferred embodiment of the present invention it is fixed at the time of assembly of the material separator 100 to be at or about 45°.

The vacuum created by air compressor 10 and injector tubes 6 draws vacuumed material 32 up through vacuum hose 30, and into separation chamber 4, through angle of entry connection 26. As discussed above, because angle of entry connection 26 is at an angle to separation chamber 4, vacuumed material 32 will have both an upward and horizontal velocity component, therefore causing the vacuumed material 32 to strike against the inner wall of separation chamber 4. This causes the vacuumed material 32 to slow down somewhat, allowing the lower specific gravity material 34 to continue up the separation chamber 4, and the higher specific gravity material 28 to fall to the bottom 5 of the separation chamber 4. The lower specific gravity material 34 continues up the separation chamber 4, through connecting hose 8, and is then expelled out of the discharge tube 2. Alternatively, the discharged lower specific gravity material 34 can be piped to some other desirable location. The higher specific gravity material 28 builds up in the bottom of the separation chamber until the weight of the build-up opens the automatic unloader valve 20. In a first embodiment of the present invention, the amount of build-up of higher specific gravity material 28 and the amount of time between successive openings of the automatic unloader valve 20 is controlled by the position of a counterweight 18 on the valve arm 16. In another embodiment of the present invention, the automatic unloader valve 20 is opened by a pneumatic piston 75 (that runs on compressed air), that is timed to open at a determinable interval. This is shown and described in greater detail with respect to FIGS. 6A-E below. The determinable interval is preferably set to six seconds, but can be changed depending upon the particular circumstances and operating conditions. In this additional embodiment of the present invention, level sensor 70 (operation of which in conjunction with an unloader valve assembly 71 is described in greater detail with respect to FIG. 3 below), can be omitted since emptying of the separation chamber 4 is accomplished on an adjustable timed basis.

The one-step material separator 100 has particular utility in shooting ranges in which the backstop is comprised of small rubber pieces. The material separator 100 vacuums the rubber and bullets off the range, separates the bullets, and blows the rubber pieces back, all in one continuous processing loop. Frame 22 and air compressor 10 can be combined as an integral unit in the material separator 100, and can be fabricated small enough to enter through a standard sized door and wheeled into position. The material separator 100 can separate other materials with different specific gravities, such as sand and bullets, or paper and bullets, among other combinations. The material separator 100 is advantageous over prior art systems because of its continuous operating properties and its integral, mobile structure.

Figure 2:
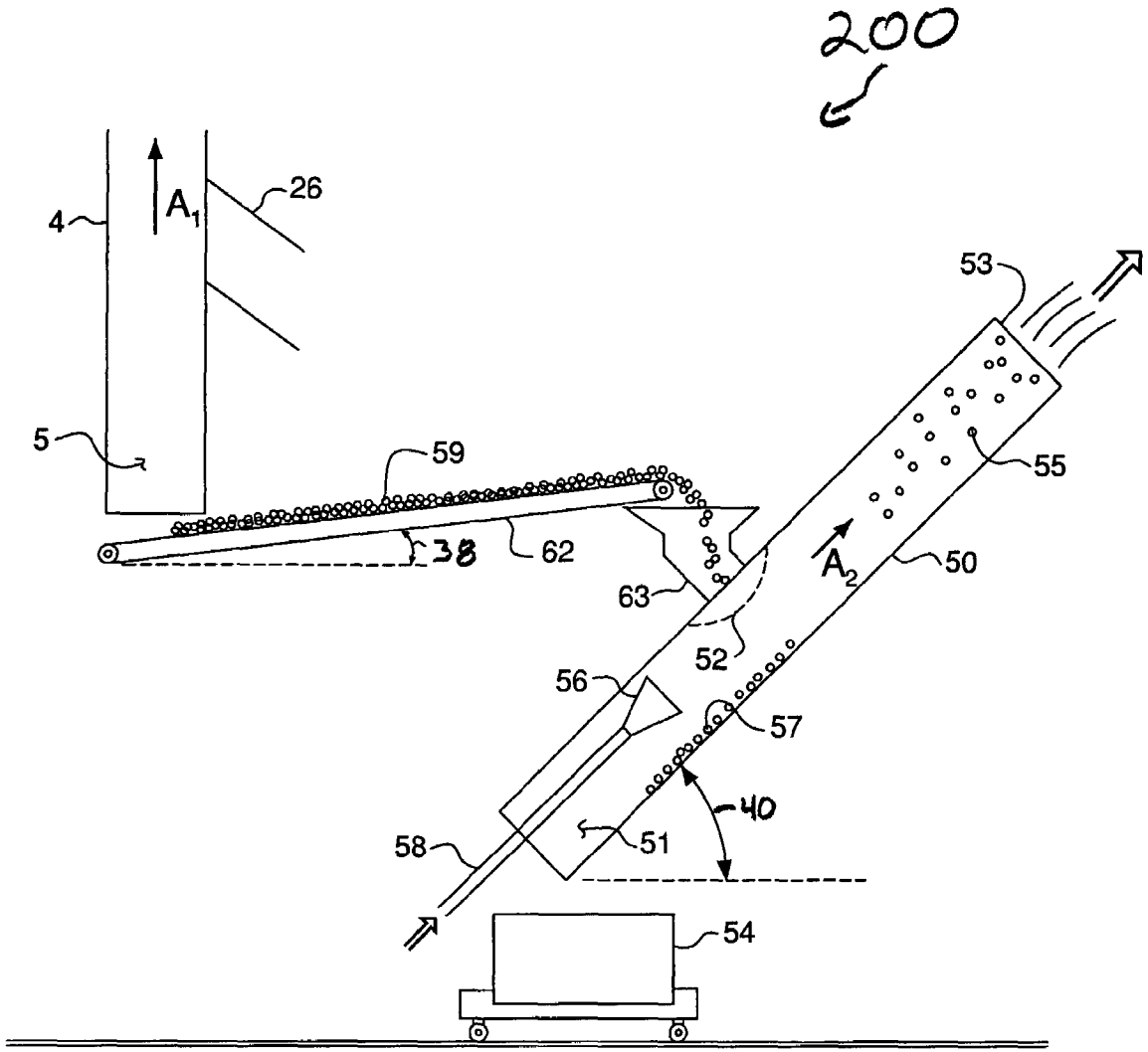
FIG. 2 is a block diagram of a mobile air powered material separator in accordance with a second embodiment of the present invention.

FIG. 2 is a block diagram of a mobile air powered material separator 200 in accordance with a second embodiment of the invention. Although the first embodiment of the invention shown in FIG. 1 operates very well (up to 95% efficiency in separating the lower specific gravity material 34 from the higher specific gravity material 28) in some applications, it can be necessary to further cleanse the lower specific gravity material from the higher specific gravity material. This can be especially true in firearm training facilities that have not had their backstop material cleaned for extended periods of time. In this case, there is an alternative method for further cleansing of the backstop material. Shown in FIG. 2 are conveyor belt 62, second discharge tube 50, air cone adapter 56 and second air hose 58. As the highly cleansed higher specific gravity material 59 falls to the bottom of separation chamber 4, it falls onto conveyor belt 62. There can be an automatic unloader valve 20 as in the first embodiment illustrated in FIG. 1 (or unloader valve assembly 71 discussed below), but that is not required.

Once the highly cleansed higher specific gravity material 59 falls onto conveyor belt 62, it is carried at an incline of first angle 38 to the top of the conveyor belt 62, where it falls off the conveyor belt 62 through a hopper 63 then through hole 52 in second discharge tube 50. First angle 38 can be between 30° and 40°, but is preferably at or about 35°. The material separator 200 can be manufactured such that first angle (as well as second angle 40, discussed below) is field-adjustable, but, in a preferred embodiment of the present invention, the first and second angles 38 and 40 are set at time of manufacture and are not adjusted in the field. A second hopper can be placed at the bottom 5 of separation tube 4 to guide the highly cleansed higher specific gravity material 59 onto the conveyor belt 62. Thereafter, a guide can be placed to spread out the highly cleansed higher specific gravity material 59 on the conveyor 62. The guide and second hopper are not shown in FIG. 2. Placed within the lower end 51 of second discharge tube 50 is an air cone adapter 56. There is a space between air cone adapter 56 and the floor of lower end 51 of second discharge tube 50. Generally, the air cone adapter 56 is approximately half the diameter of the second discharge tube 50, though that ratio is not critical.

Attached to the end of air cone adapter 56 is second air hose 58, which is attached to air compressor 10. Air is forced through second air hose 58 into air cone adapter 56 which causes the air to flow through the second discharge tube 50 and out the upper end 53 of second discharge tube 50. As the highly cleansed higher specific gravity material 59 falls through hole 52, the higher specific gravity material (in this instance, bullets 57) falls down second discharge tube 50, under air cone adapter 56, and out of second discharge tube 50 into container 54. The air being forced through air cone adapter 56 and second discharge tube 50 causes the lower specific gravity material (in this instance, the granulated rubber backstop material 55) to be discharged forcibly from the upper end 53 of second discharge tube 50. The result is that the material falling from the second discharge air tube 50 (bullets 57) is extremely clean; in many instances over 99% free of the lower specific gravity material 34 (granulated rubber backstop material 55).

A small space between air cone adapter 56 and the floor of second discharge tube 50 is maintained so that the highly cleansed higher specific gravity material 59 can fall out of second discharge air tube 50 into container 54 (which can have wheels as shown for convenient transport). In a preferred embodiment of the present invention, the container 54 is a 30 gallon drum that rests on a pallet, so that an operator can move it. By way of example, the pallet and drum can weigh approximately 1000 lbs. when the drum is two-thirds filled with used bullets. The operator will use a pallet jack to move the partially filled drum and pallet.

Figure 3:
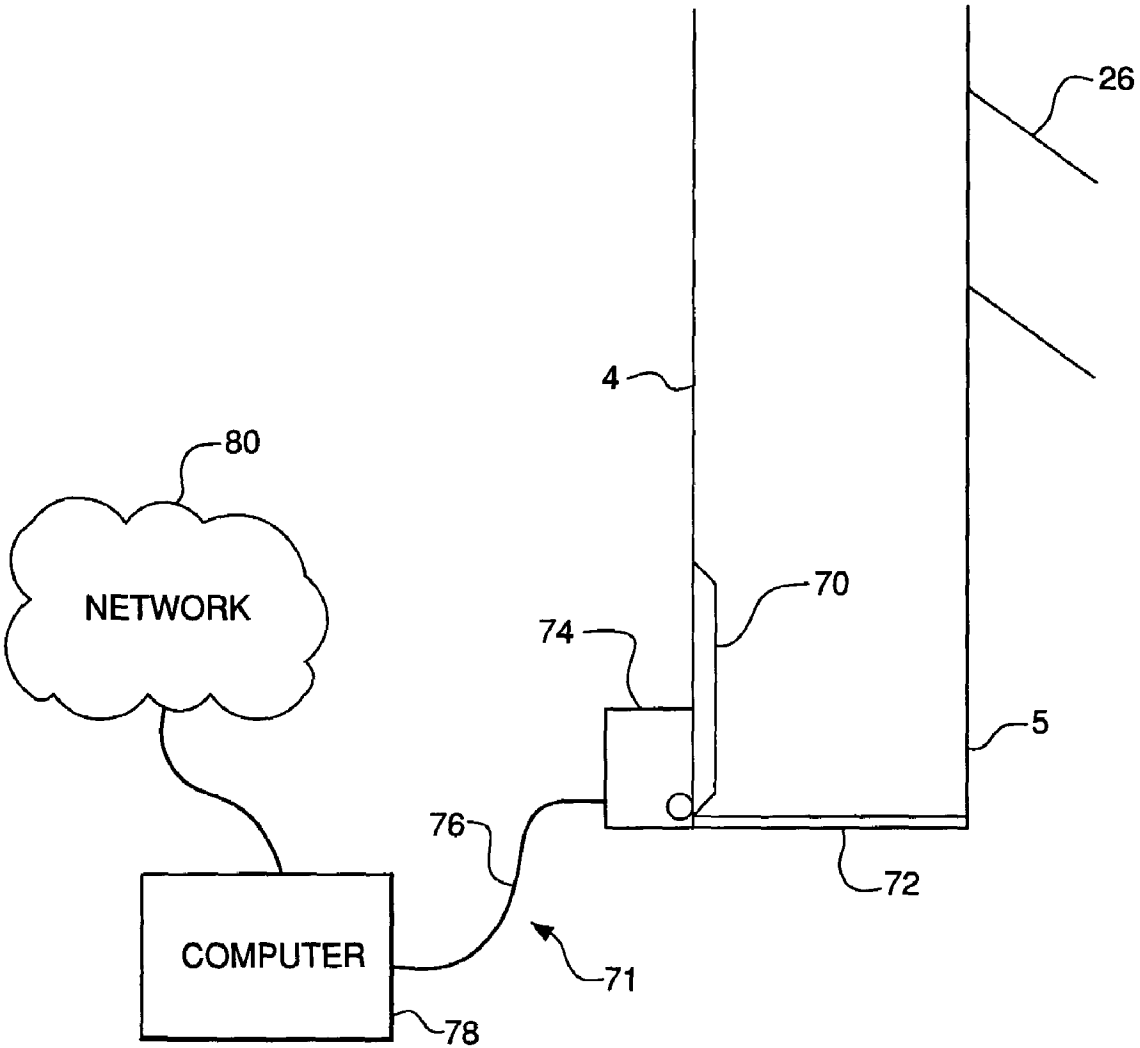
FIG. 3 is a block diagram of an alternative unloader valve for the material separator in accordance with a third embodiment of the present invention.

FIG. 3 is a block diagram of an alternative unloader valve for the material separator in accordance with a third embodiment of the invention. In the embodiment illustrated in FIG. 3, the automatic unloader valve 20 of FIG. 1 has been replaced with unloader valve assembly 71, which is comprised of unloader valve 72, valve servo 74, level sensor 70, computer 78 and can include a communications network 80. In this embodiment of the present invention, the level sensor 70 determines when it is time to empty separation tube 4. The level sensor 70 can be a weight sensor, an optical sensor, or even operate by an indirect measurement, such as an electrical characteristic (resistance, capacitance or inductance), as well as many other types of sensing mechanisms.

Operation of unloader valve assembly 71 begins with level sensor 70 reporting to computer 78 its measurements. When the measurement reaches or surpasses a predefined point, computer 78 transmits a signal to valve servo 74, which opens unloader valve 72, causing the higher specific gravity material 28 to fall away from separation tube 4. In this case, there can be a conveyor which carries the higher specific gravity material 28 away from the immediate area. In some cases, computer 78 can completely control material separator 100, such that it operates automatically. Computer 78 can be in communications with other computers via network 80. A remote computer (not shown) can operate material separator 100 via network 80 and computer 78.

Figure 4:
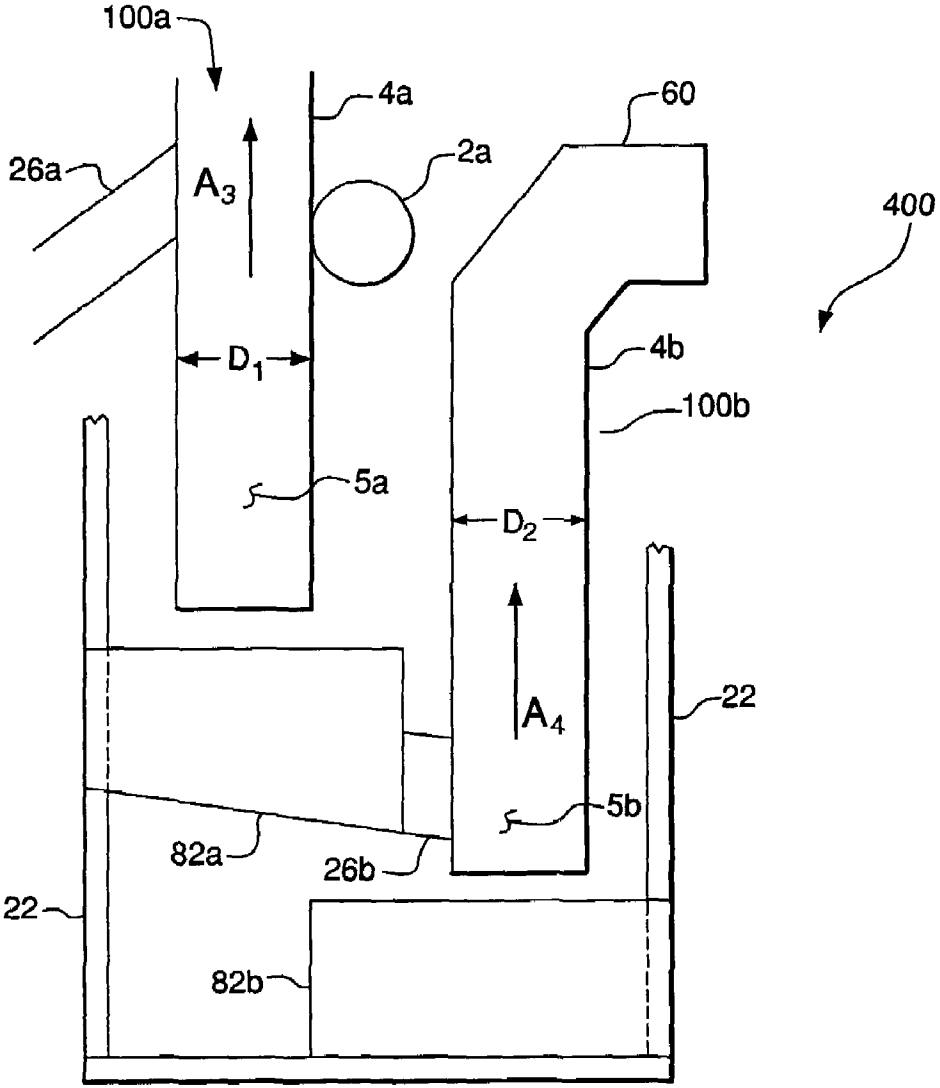
FIG. 4 is a block diagram of an mobile air powered material separator in accordance with a fourth embodiment of the present invention.

FIG. 4 is a block diagram of an mobile air powered material separator 400 in accordance with a fourth embodiment of the invention. Material separator 400 shown in FIG. 4 combines two material separators 100 from FIG. 1, with a slight modification. In the material separator 400 of FIG. 4, the first material separator 100*a* is configured as discussed above, that is, vacuumed material 32 enters the separation chamber 4*a* through angle of entry connection 26*a*. The separation chamber 4*a* discharges the lower specific gravity material 34 through discharge tube 2*a*, and the higher specific gravity material 28 is dropped to the bottom 5*a* of separation tube 4*a* where it is then deposited into bin 82*a*.

However, not all the material dropped into bin 82*a* is higher specific gravity material 28; there is some lower specific gravity material 34 mixed in. Thus, the second material separation tube 4*b* is configured as shown to further cleanse the mixed material. Second material separator 100*b* is slightly different from the first material separator 100*a* in that its angle of entry connection 26*b* is sloped downward and into separation chamber 4*b* as opposed to upward and into separation chamber 4*a* of material separator 100*a*. In one embodiment of the present invention, the diameter D2 of the second separation chamber 4*b* is smaller than the diameter D1 of the first separation chamber 4*a*. However, in a preferred embodiment of the present invention, the diameters of the two separation chamber 4*a* and 4*b* are substantially the same. In this case, the air flow in the second separation chamber 4*b* is adjusted to be less than the air flow in the first separation chamber 4*a*. The reason for this is because the material entering the second separation chamber 4*b* is much cleaner than the material than that which entered the first separation chamber 4*a*, there does not have to be as much air flow, or vacuum in the second separation chamber 4*b*. This conserves the air flow needed from air compressor 10, making the configuration more efficient Also, the second separation chamber 4*b* can be shorter than the first separation chamber 4*a*.

As the highly cleansed higher specific gravity material 59 leaves the first separation chamber 4*a*, it is deposited in first bin 82*a*, and then is drawn into the second angle of entry connection 26*b* from the vacuum developed through the second separation chamber 4*b* (although the air hoses 14, air compressor 10 and other elements shown in FIG. 1 have not been shown in FIG. 4, creation of the vacuum through the venturi effect occurs just as described in detail above). Also, there can be a vibrator plate (not shown in FIG. 4) on the bottom of bin 82*a* which would assist the travel of the highly cleansed higher specific gravity material 59 down the slope of the bottom of the first bin 82*a* into the second angle of entry connection 26*b*. The highly cleansed higher specific gravity material 59 that enters into the second separation chamber 4*b* through the second angle of entry connection 26*b* is acted upon by the vacuum that is present in the second separation chamber 4*b*. The higher specific gravity material 28 falls to the bottom 5*b* of the second separation chamber 4*b* (bullets 57), and then is deposited into second bin 82*b*. The lower specific gravity material 34 is forced upward through the second separation chamber 4*b*, and out directional discharge nozzle 60. This places the lower specific gravity material 34 (in the case of the firearms facility, granulated rubber backstop material 55), to its original location. The unloader valve assembly 71 of FIG. 3 can be used in the material separator 400 of FIG. 4, and the entire assembly of material separator 400 can also be placed on one frame 22, as shown and described in reference to FIGS. 6A-E.

Figure 5:
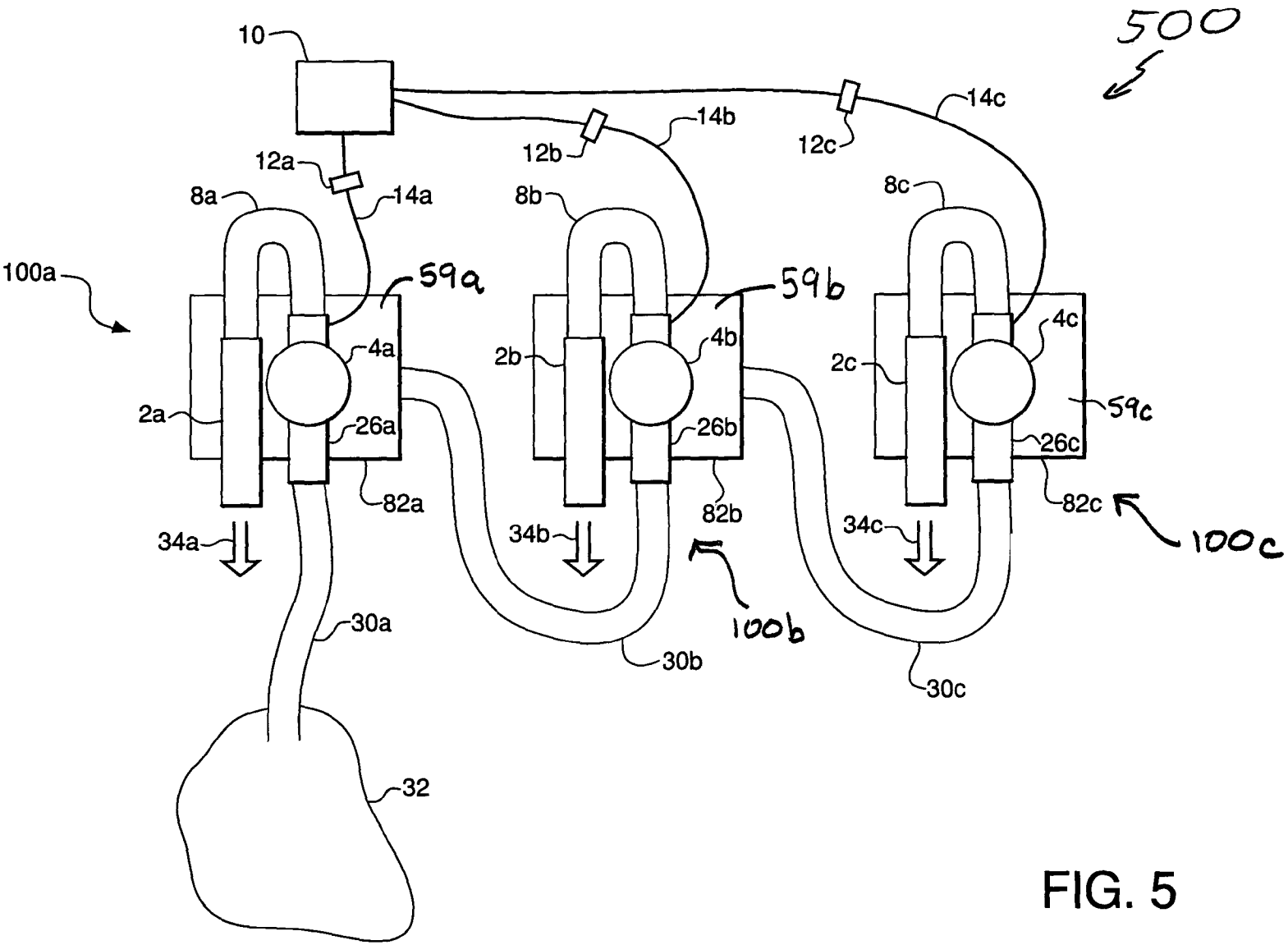
FIG. 5 is a block diagram of a mobile air powered material separator in accordance with a fifth embodiment of the present invention.
Figure 6A:
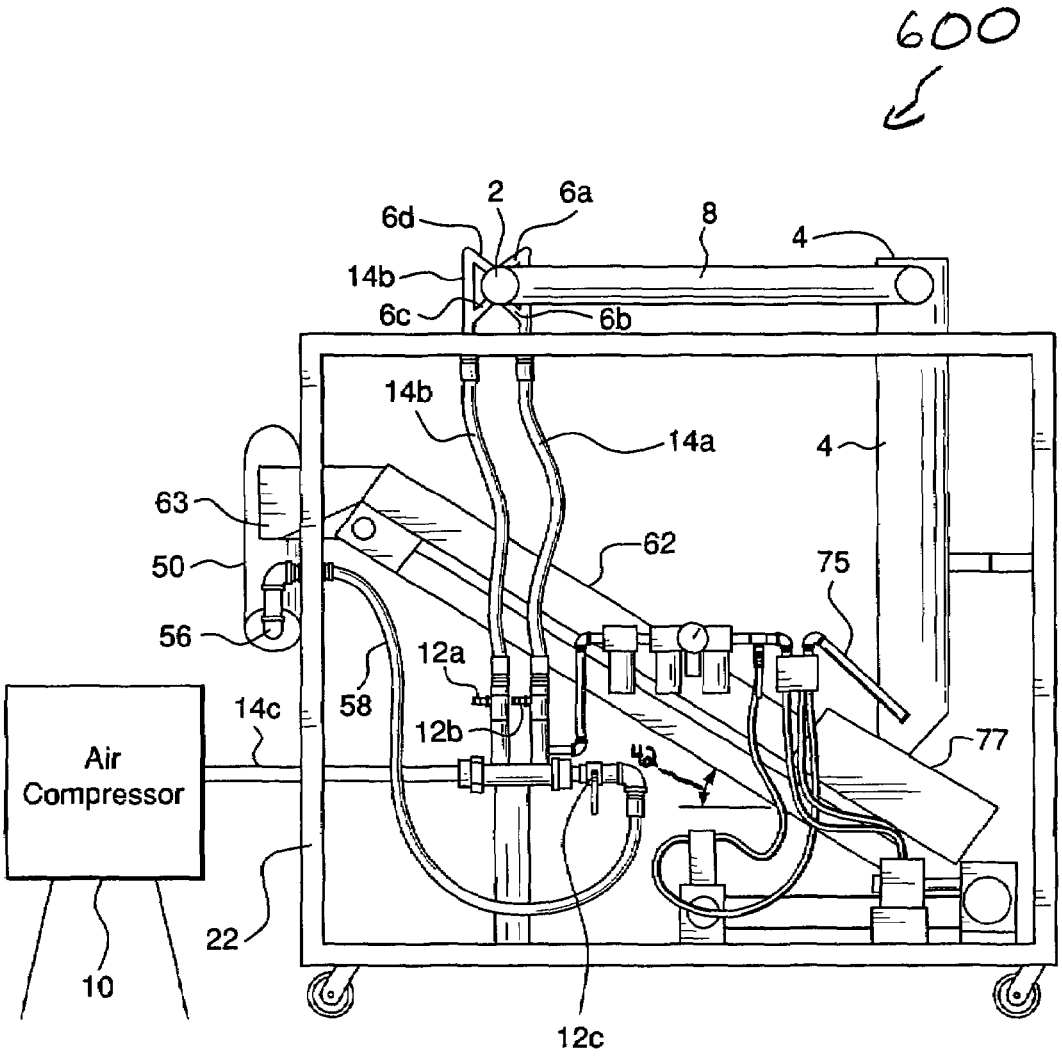
FIGS. 6A-E illustrate several perspective views of a sixth embodiment of the present invention.
Figure 6B:
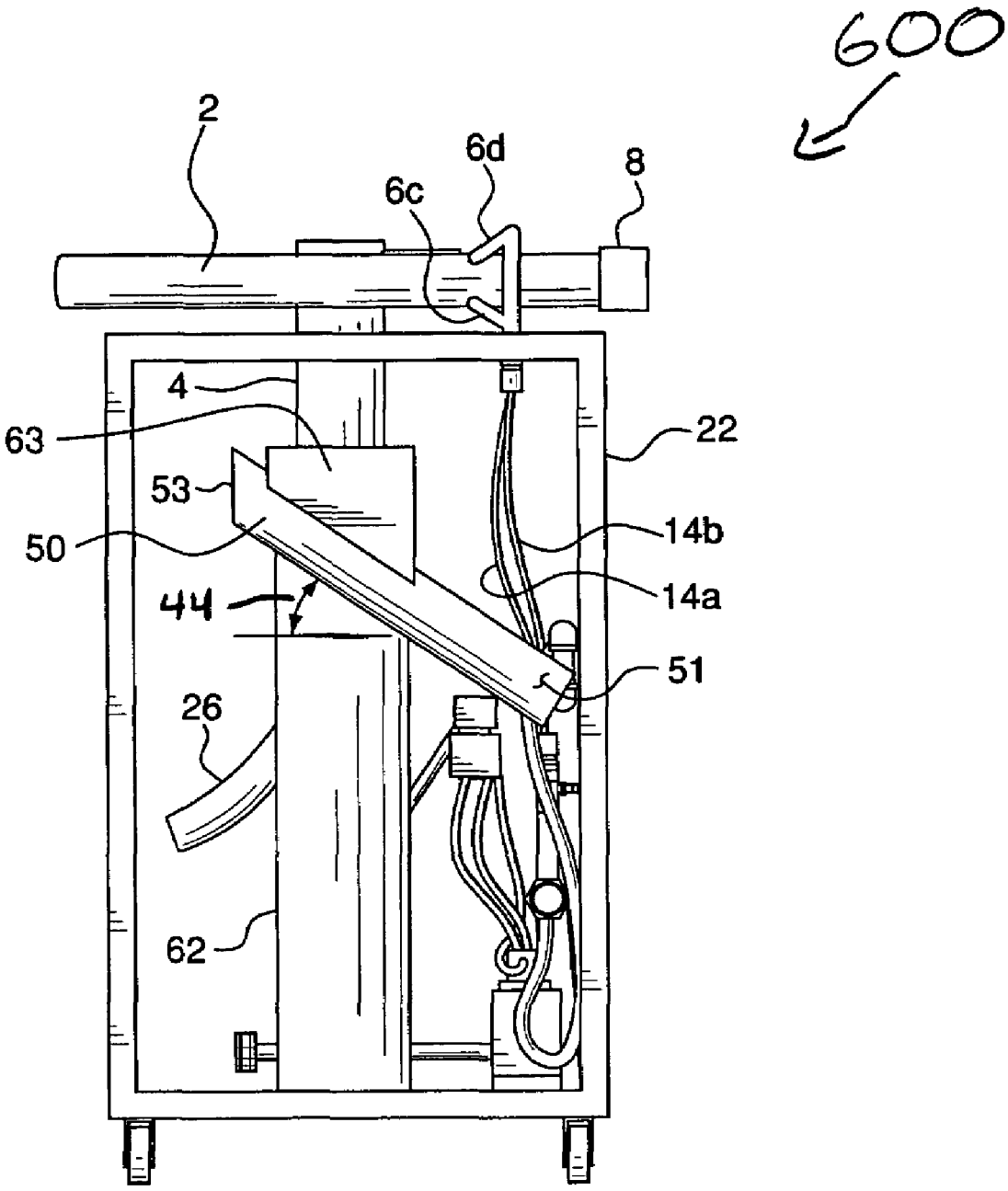
Figure 6C:
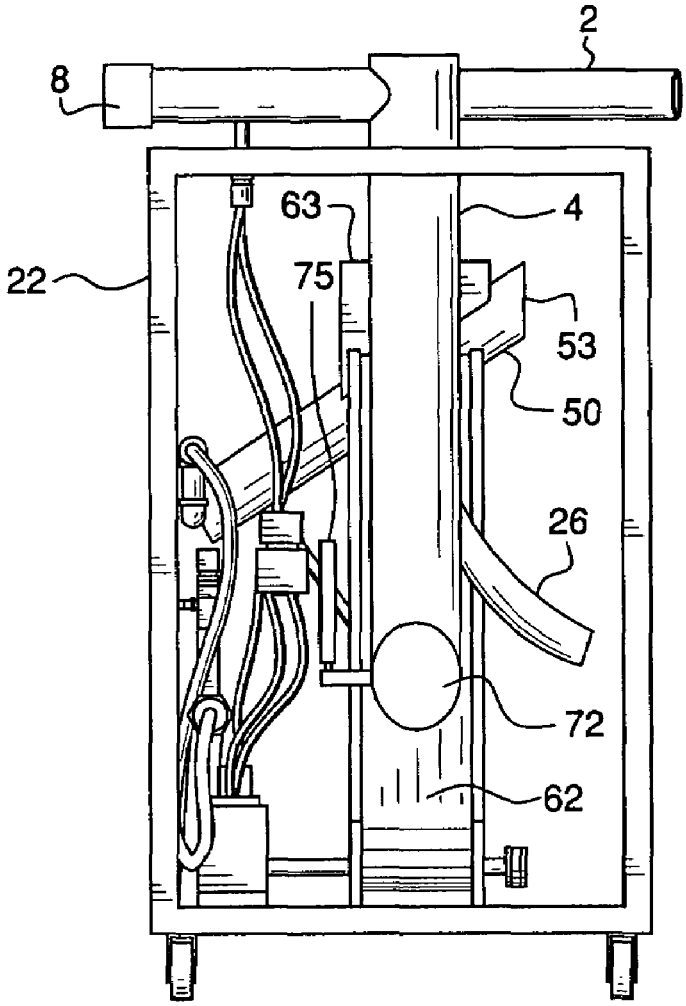
Figure 6D:
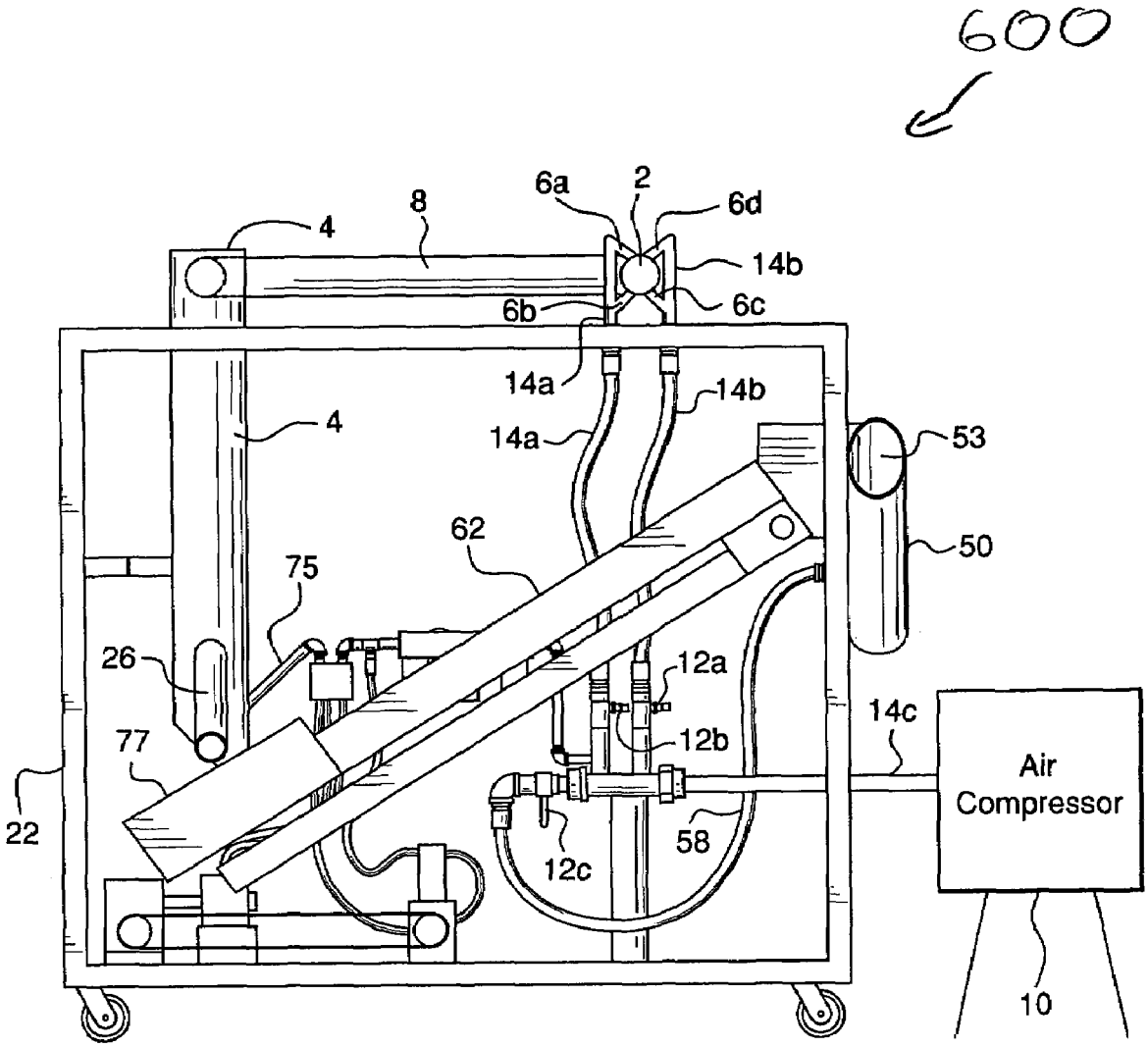
Figure 6E:
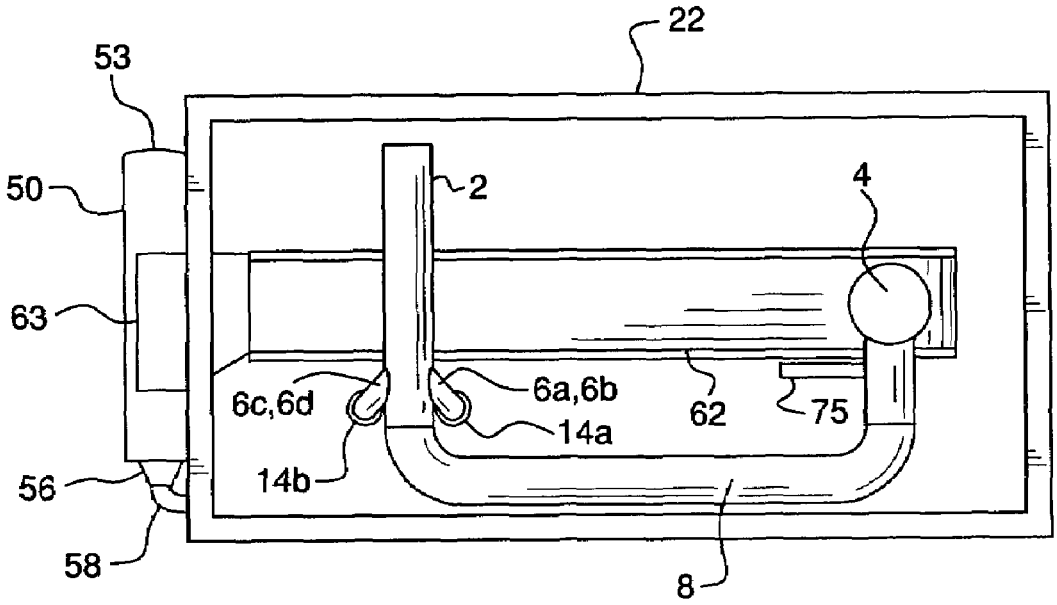

FIG. 5 is a block diagram of a mobile air powered material separator 500 in accordance with a fifth embodiment of the invention. The embodiment illustrated in FIG. 54 is used when it is necessary to clean the mixed material extremely well. Although the embodiment of FIG. 5 shows three material separators, 100*a*, 100*b* and 100*c* connected together, it will be apparent to one skilled in the art that there is no limit as to how many material separators 100 can be connected in such a series arrangement.

In FIG. 5 first material separator 100*a* vacuums mixed material 32 in the normal manner as described above. Eventually, lower specific gravity material 34 is discharged via discharge tube 30*a*, and higher and some lower specific gravity material 28 and 34 is deposited into bin 82*a*. This material is referred to as first highly cleansed higher specific gravity material 59*a*. Once bin 82*a* reaches a certain level, second material separator 100*b* is engaged (perhaps through unloader valve assembly 71), vacuums the first highly cleansed higher specific gravity material 59*a* into separation chamber 4*b* and performs the separation process again, as described above. In this instance, however, the material deposited into bin 82*b* is even more highly separated and is very nearly all higher specific gravity material 28. This material is second highly cleansed higher specific gravity material 59*b*. But, in some instances, that might not be sufficient, and hence a third material separator 100*c* is engaged, again separating the lower specific gravity material 34 from the higher specific gravity material 28. Then, what is discharged from discharge tube 2*c* is lower specific gravity material 34, and substantially only higher specific gravity material 28 is deposited into bin 82*c* (third highly cleansed higher specific gravity material 59*c*).

It is possible, using the embodiment illustrated in FIG. 5, to separate four or more different specific gravity materials. Since the output of air compressor 10 can be calibrated for each material separator 100, different flow levels can be established through use of air adjustment valves 12*a-c*. The operation of the embodiment shown in FIG. 4 would then be as follows. Material 32 contains four materials, with specific gravities g1, g2, g3 and g4, respectively. Specific gravity g1 is greater than g2, g2 is greater than g3, and g3 is greater than g4. Thus, the material with specific gravity g1 is the heaviest, and the material with specific gravity g4 is the lightest. Air flow 110*a*, established through air compressor 10, air adjustment valve 12*a* and air tube 14*a*, is strong enough to only vacuum the material with specific gravity g4 up separation tube 4*a*. The materials with specific gravities g1, g2 and g3 fall into bin 82*a*, as described above (first highly cleansed higher specific gravity material 59*b*). Material 34*a* with specific gravity g4 is then discharged through discharge tube 2*a*.

The process repeats in material separator 100*b*. First highly cleansed higher specific gravity material 59*a* is vacuumed into second separation chamber 4*b*. Here though, air flow 110*b*, established through air compressor 10, air adjustment valve 12*b* and air tube 14*b*, is strong enough to only vacuum material with specific gravity g3 and what remains of the material with specific gravity g4 up separator tube 4*b*. Material 34*b* with specific gravities g3 and g4 is then discharged through discharge tube 2*b*. Materials with specific gravities g1 and g2 fall into bin 82*b* (along with a substantially lesser amount of materials with specific gravities g3 and g4). This is second highly cleansed higher specific gravity material 59*b*. Material separator 100*c* then vacuums materials with specific gravities g1 and g2, and the substantially lesser amounts of materials with specific gravities g3 and g4 (second highly cleansed higher specific gravity material 59*b*) into separator tube 4*c*. Air flow 110*c*, established through air compressor 10, air adjustment valve 12*c* and air tube 14*c*, is strong enough to only push material with specific gravity g2 (and materials with specific gravities of g3 and g4) up separation tube 4*c*. The heaviest material, with specific gravity g1 (third highly cleansed higher specific gravity material 59*c*), is in bin 82*c*, and the material with specific gravity g2 (along with whatever remains of materials with specific gravities g3 and g4) is discharged via discharge tube 2*c* (material 34*c*). Through operation of three material separators, four different materials have been separated: material with specific gravity g4 through discharge tube 34*a*; material with substantially only specific gravity g3 through discharge tube 34*b*; material with substantially only specific gravity g2 through discharge tube 34*c*, and material with substantially only specific gravity g1 rests in bin 82*c*.

Of course, further refinement can take place by combining the embodiment of FIG. 2 with the embodiment of FIGS. 4 and 5.

FIGS. 6A-E illustrate several perspective views of a sixth embodiment of the present invention. In FIGS. 6A-E, many of the components of the previous embodiments have been utilized, along with some new ones, in order to create a more compact, versatile material separator 600. The material separator 600 shown in FIGS. 6A-E comprises a frame 22, onto which is assembled a separation chamber 4 (attached to which is angle of entry connection 26 and unloader valve 72), a conveyor 62, air hoses 14*a-c*, second discharge tube 50, an air cone adapter 56, second air hose 58 (attached to an air compressor 10), hopper 63 and second hopper 77.

Operation of the material separator 600 of FIGS. 6A-E is essentially the same as that discussed in FIG. 2. As the highly cleansed higher gravity material 59 falls to the bottom of separation chamber 4, it falls onto conveyor belt 62. There can be an automatic unloader valve 20 as in the first embodiment illustrated in FIG. 1, but that is not required.

Once the highly cleansed higher gravity material 59 falls onto conveyor belt 62, it is carried at a third angle 42 of inclination of between 30° and 40° to the top of the conveyor belt 62, where it falls off the conveyor belt 62 through a hopper 63 into second discharge tube 50. Preferably, the third angle 42 of inclination of the conveyor 62 is at or about 35°. Though the third angle 42 of inclination of the conveyor 62 can be varied, in a preferred embodiment of the present invention, the third angle 42 of inclination of conveyor 62 is fixed to be at or about 35° when the material separator 100 is assembled. A second hopper 77 is located at the bottom 5 of separation tube 4, to guide the highly cleansed backstop material 59 onto the conveyor belt 62. Thereafter, a guide can be placed to spread out the highly cleansed backstop material on the conveyor 62. The guide is not shown in FIGS. 6A-E. Placed within the lower end 51 of second discharge tube 50 is air cone adapter 56. There is a space between air cone adapter 56 and the floor of the second discharge tube 50. Generally, the air cone 56 is approximately half the diameter of the second discharge tube 50, though that ratio is not critical.

Attached to the end of air cone adapter 56 is second air hose 58, which is attached to air compressor 10. Air is forced through second air hose 58 into air cone adapter 56 which causes the air to flow through the second discharge tube 50 and out the upper end 53 of second discharge tube 50. As the highly cleansed higher specific gravity material 59 falls through the hopper 63, substantially all of the higher specific gravity material 59 (in this instance, bullets 57) falls down second discharge tube 50, under air cone adapter 56, and out of second discharge tube 50 into a container 54 (container 54 is not shown in FIGS. 6A-E). The air being forced through air cone adapter 56 and second discharge tube 50 causes the lower specific gravity material 34 (in this instance, the granulated rubber backstop material 55) to be discharged forcibly from the upper end 53 of second discharge tube 50. The result is that the material discharged from the second discharge air tube 50 is comprised of the lower specific gravity material 34, and the material that falls from second discharge tube 50 into container 54, higher specific gravity material 28 (bullets 57) is extremely clean; in many instances over 99% free of the lower specific gravity material 34 (granulated rubber backstop material 55).

Third angle 42 represents the angle by which the conveyor belt 62 is inclined from the horizontal, and fourth angle 44 is the angle by which the second discharge tube 50 is inclined from the horizontal. In a preferred embodiment of the invention, the third angle 42 is at or about 35°, and fourth angle 44 is at or about 45°. As discussed above, while the fourth angle 44 can be made to be field adjustable, in the preferred embodiment of the present invention, the fourth angle 44 is fixed at the time of manufacture of the material separator 600 to be at or about 45°.

Container 54, in a preferred embodiment of the present invention, is a 30 gallon drum that rests on a pallet, so that an operator can easily move it. By way of example, the pallet and drum can weigh approximately 1000 lbs. when the drum is two-thirds filled with used bullets. The operator will use a pallet jack to move the partially filled drum and pallet. In another embodiment of the present invention, as discussed above, container 54 itself can have wheels for convenient transport, The present invention has been described with reference to certain exemplary embodiments thereof. However, it will be readily apparent to those skilled in the art that it is possible to embody the invention in specific forms other than those of the exemplary embodiments described above. This may be done without departing from the spirit and scope of the invention as defined in the appended claims and equivalents thereof. The exemplary embodiments are merely illustrative and should not be considered restrictive in any way.

The invention claimed is:

1. A method for separating mixed particulate material into particles of at least two different specific gravities, comprising:

providing at least one mixed particulate material separating apparatus including a separating chamber with an inlet and an outlet, a discharge tube having a first end coupled to the outlet of the separating chamber and a second end defining a discharge outlet and an angle of entry connection having a longitudinal axis, a discharge of the angle of entry connection and the longitudinal direction of the entry connection being angled upwardly at an incline with respect to a longitudinal axis of the separating chamber;

creating a vacuum at the first end of the discharge tube which provides suction to the separating chamber to draw mixed particulate material into the separating chamber through the angle of entry connection in a linear direction toward a wall of the separating chamber so that the mixed particulate material has both upward and horizontal velocity components, the horizontal velocity component being sufficient to cause the mixed particulate matter to strike the wall of the separating chamber at a location opposite the entry connection;

separating the mixed particulate material into a lower specific gravity and a higher specific gravity by the vacuum pulling the lower specific gravity material up and out of the mixed particulate material separating apparatus via the discharge tube, and allowing the higher specific gravity material to fall from the separating chamber; and producing a positive pressure at the second end of the discharge tube and discharging the lower specific gravity material through the discharge outlet.

2. The method for separating mixed particulate material into particles of at least two different specific gravities according to claim 1, further comprising:

providing the mixed particulate material to the mixed particulate material separating apparatus.

3. The method for separating mixed particulate material into particles of at least two different specific gravities according to claim 2, further comprising:

collecting the material with a higher specific gravity at a bottom of the separating chamber; and releasing the collected material with a higher specific gravity at a predetermined interval of time.

4. The method for separating mixed particulate material into particles of at least two different specific gravities according to claim 1, wherein the angle between the longitudinal axis of the angle of entry connection and the longitudinal axis of the separation chamber is between about 40° and 50°.

5. The method for separating mixed particulate material into particles of at least two different specific gravities according to claim 1, wherein the angle between the longitudinal axis of the angle of entry connection and the longitudinal axis of the separation chamber is about 45°.

6. The method of claim 1, wherein said entry connection is coupled to a feed conduit for supplying the particulate material to the separating chamber, the feed conduit having a substantially rectilinear portion coaxially connected to the entry connection and extending at said inclined angle, said method comprising drawing said particulate material in a substantially rectilinear path through the feed conduit and entry connection at the inclined angle to the wall of the separating chamber.

7. The method of claim 1, wherein said discharge tube includes at least one injector tube extending through a side wall of the discharge tube, said method comprising injecting pressurized air through the injector tube in a direction toward the discharge outlet to produce the positive pressure in an area downstream of the injector tube with respect to the direction of travel of the lower specific gravity material, and to produce the vacuum in an area upstream of the discharge tube and the separating chamber.

8. A method for separating mixed particulate material into particles of at least two different specific gravities, comprising:

providing a first mixed particulate material separating apparatus including a separating chamber, and an angle of entry connection, the angle of entry connection having a longitudinal axis being angled upwardly at an inclined angle with respect to a longitudinal axis of the separating chamber;

creating a vacuum in an outlet of the separating chamber whereby mixed particulate material enters the mixed particulate material separating apparatus through the angle of entry connection so that the mixed particulate material has both upward and horizontal velocity components, the horizontal velocity component being sufficient to cause the mixed particulate matter to strike a wall of the separating chamber at a location opposite the entry connection;

separating initially the mixed particulate material into a lower specific gravity and a higher specific gravity by the vacuum pulling at least a portion of the lower specific gravity material up and out of the separating chamber of the first mixed particulate material separating apparatus, and allowing an initially separated mixed particulate material which comprises the higher specific gravity material and remainder of the lower specific gravity material to fall downward in the separating chamber of the mixed particulate material separating apparatus;

moving the initially separated mixed particulate material to a second mixed particulate material separating apparatus;

providing a flow of air from an air flow source to the second mixed particulate material separating apparatus; and separating further the mixed particulate material into a lower specific gravity and a higher specific gravity by the flow of air discharging at least a portion of the remainder of the lower specific gravity material up and out of the second mixed particulate material separating apparatus, and allowing the higher specific gravity material to fall from the second mixed particulate material separating apparatus.

9. The method for separating mixed particulate material into particles of at least two different specific gravities according to claim 8, further comprising:

transporting the higher specific gravity material away from the second mixed particulate material separating apparatus.

10. The method for separating mixed particulate material into particles of different specific gravities according to claim 8, wherein the step of moving the initially separated mixed particulate material to the second mixed particulate material separating apparatus comprises:

transporting the initially separated mixed particulate material to a second discharge tube.

11. The method for separating mixed particulate material into particles of at least two different specific gravities according to claim 8, wherein the angle between the longitudinal axis of the angle of entry connection and the longitudinal axis of the separation chamber is between about 40° and 50°.

12. The method for separating mixed particulate material into particles of at least two different specific gravities according to claim 8, wherein the angle between the longitudinal axis of the angle of entry connection and the longitudinal axis of the separation chamber is about 45°.

13. The method of claim 8, wherein the outlet of the separating chamber is connected to a first end of a discharge tube, the discharge tube having a second end defining a discharge outlet, the method comprising producing a positive pressure at the second end of the discharge tube to discharge the particulate material.

14. The method of claim 13, wherein said discharge tube includes an injector tube extending through a side wall of the discharge tube, the method further comprising injecting pressurized air through the injector tube to produce the positive pressure in an area downstream of the injector tube.

15. The method of claim 14, comprising positioning the injector tube at an inclined angle with respect to an axis of the discharge tube and directing the pressurized air into the discharge tube at the inclined angle.

16. The method of claim 15, comprising injecting the pressurized air into the discharge tube to produce the vacuum in an area upstream of the injector tube.

17. The method of claim 13, wherein said discharge tube includes a plurality of injector tubes extending through a side wall of the discharge tube at an inclined angle directed toward the discharge end, the method further comprising injecting pressurized air through the injector tubes to produce the positive pressure in an area downstream of the injector tubes and to produce the vacuum in an area upstream of the injector tubes.

18. The method of claim 17, wherein the entry connection is coupled to a feed conduit for supplying the particulate material to the separation chamber, the feed conduit having a substantially rectilinear portion coaxially connected to the entry connector and extending at said inclined angle, the method further comprising drawing the particulate material in a rectilinear path through the feed conduit and the entry connector at the inclined angle.

19. A method for separating mixed particulate material into particles of at least two different specific gravities, comprising:

providing a first mixed particulate material separating apparatus including a separating chamber having a longitudinal axis, and an angle of entry connection, the angle of entry connection having a longitudinal axis being angled upwardly at an inclined angle with respect to the longitudinal axis of the separating chamber;

creating a vacuum in an outlet of the separating chamber whereby mixed particulate material enters the separating chamber of the first mixed particulate material separating apparatus through the angle of entry connection so that the mixed particulate material has both upward and horizontal velocity components, the horizontal velocity component being sufficient to cause the mixed particulate matter to strike a wall of the separating chamber at a location opposite the entry connection;

separating initially the mixed particulate material into a first group and a second group of mixed particulate material by the vacuum pulling at least a portion of the first group of mixed particulate material up and out of the separating chamber of the first mixed particulate material separating apparatus, and allowing the second group of mixed particulate material to fall downward in the separating chamber of the first mixed particulate material separating apparatus;

providing a second mixed particulate material separating apparatus and a second flow of air from an air flow source through the second mixed particulate material separating apparatus.

20. The method for separating mixed particulate material into particles of at least two different specific gravities according to claim 19, wherein the angle between the longitudinal axis of the angle of entry connection and the longitudinal axis of the separation chamber is between about 40° and 50°.

21. The method for separating mixed particulate material into particles of at least two different specific gravities according to claim 19, wherein the angle between the longitudinal axis of the angle of entry connection and the longitudinal axis of the separation chamber is about 45°.

22. The method of claim 19, wherein the apparatus further includes a discharge tube having a first end connected to the outlet of the separating chamber and a second end defining a discharge outlet, a plurality of injector tubes extending through a wall of the discharge tube at an inclined angle toward the discharge end, the method comprising injecting pressurized air through the injector tubes toward the discharge end to produce a positive pressure in an area downstream of the injector tubes to discharge the particulate material and to produce the vacuum in an area upstream of the injector tubes and in the separating chamber.

23. The method of claim 22, wherein the apparatus includes a feed conduit having a first end coupled to the entry connection and a second end for receiving the particulate material from a supply, the feed conduit having a substantially rectilinear portion coaxially connected to the entry connector and extending at the inclined angle, the method further comprising drawing the particulate material in a rectilinear direction through the feed conduit and the entry connector into the separation chamber at the inclined angle.

* * * * *